US010010468B2

(12) United States Patent
Duquette et al.

(10) Patent No.: US 10,010,468 B2
(45) Date of Patent: Jul. 3, 2018

(54) INFECTION CONTROL STRAP AND PATIENT LIFTING SYSTEM

(71) Applicant: 1073849 ONTARIO LIMITED, Barrie (CA)

(72) Inventors: Noel Duquette, Barrie (CA); Samuel Andrew Gibney, Barrie (CA); Stephen Van Noortwyk, Barrie (CA); Ivan Clark, Barrie (CA)

(73) Assignee: 1073849 ONTARIO LIMITED (CA)

( * ) Notice: Subject to any disclaimer, the term of this patent is extended or adjusted under 35 U.S.C. 154(b) by 413 days.

(21) Appl. No.: 14/697,848

(22) Filed: Apr. 28, 2015

(65) Prior Publication Data

US 2016/0000625 A1 Jan. 7, 2016

Related U.S. Application Data

(63) Continuation-in-part of application No. 12/558,077, filed on Sep. 11, 2009, now abandoned.
(Continued)

(51) Int. Cl.

| | |
|---|---|
| ***A61G 7/10*** | (2006.01) |
| ***D07B 5/00*** | (2006.01) |
| *D07B 1/22* | (2006.01) |

(52) U.S. Cl.
CPC ..... *A61G 7/1042* (2013.01); *A61G 7/1015* (2013.01); *A61G 7/1069* (2013.01);
(Continued)

(58) Field of Classification Search
CPC ..... D07B 2205/2064; D07B 2801/22; D07B 1/20; D07B 2501/2007; D07B 5/005;
(Continued)

(56) References Cited

U.S. PATENT DOCUMENTS 2,272,778 A 2/1942 Reuter
2,350,120 A * 5/1944 Lawler ..... B66D 1/22 254/295

(Continued)

FOREIGN PATENT DOCUMENTS

EP 1452478 A1 9/2004
EP 2777674 A1 9/2014

(Continued)

OTHER PUBLICATIONS

Extended European Search Report in Application No. 09813670.8, dated Oct. 9, 2014.

(Continued)

*Primary Examiner* — Emmanuel M Marcelo
(74) *Attorney, Agent, or Firm* — J. A. Lindeman & Co., PLLC

(57) ABSTRACT

A patient lifting device includes an infection control lift strap with an inner core and an outer plastic layer that can be easily and effectively cleaned with standard disinfectant. The lift strap includes a waterproof sealed belt clamp assembly. A winch assembly includes a motor and high-efficiency gear assembly that lifts and lowers the strap with a spool assembly including an eccentric cylindrical spool. The eccentric cylindrical spool eliminates inconsistent performance of the lifting device as the strap drapes and coils onto the spool without raised attachment points. The strap includes top and bottom layers with different coefficients of friction to prevent slipping and self-tightening of the strap on the spool. The lifting device includes a thickness roller, a strap guard, and an electro-mechanical brake that locks the motor and prevents back driving. The gear assembly provides back driving when power is removed and the brake is released.

19 Claims, 13 Drawing Sheets

Related U.S. Application Data

(60) Provisional application No. 61/095,970, filed on Sep. 11, 2008.

(52) U.S. Cl.
CPC ..... *A61G 7/1078* (2013.01); *D07B 5/006* (2015.07); *A61G 2203/78* (2013.01); *D07B 1/22* (2013.01); *D07B 2205/205* (2013.01); *D07B 2205/2064* (2013.01); *D07B 2205/3007* (2013.01); *D07B 2205/3028* (2013.01); *D07B 2501/2007* (2013.01)

(58) Field of Classification Search
CPC ..... A61G 7/1015; A61G 7/1042; B66D 1/34; B66D 1/56; B66D 1/58; B66D 1/60; B66D 3/20; B66D 3/24; B66D 3/26; B66D 5/16
See application file for complete search history.

(56) References Cited

U.S. PATENT DOCUMENTS

| | | | | |
|---|---|---|---|---|
| 2,368,390 | A | 1/1945 | Winter | |
| 3,506,985 | A | 4/1970 | Lang | |
| 4,000,533 | A | 1/1977 | Higgs | |
| 4,084,275 | A * | 4/1978 | Ilon | A01K 15/00 5/81.1 T |
| 4,243,118 | A | 1/1981 | Landry | |
| 4,243,147 | A | 1/1981 | Twitchell et al. | |
| 4,372,452 | A | 2/1983 | McCord | |
| 4,634,141 | A | 1/1987 | Hagan et al. | |
| 5,072,840 | A | 12/1991 | Asakawa et al. | |
| 5,337,908 | A | 8/1994 | Beck, Jr. | |
| 5,456,655 | A | 10/1995 | Morris | |
| 5,511,256 | A | 4/1996 | Capaldi | |
| 5,524,304 | A | 6/1996 | Shutes | |
| 5,694,654 | A | 12/1997 | Roy | |
| 6,079,062 | A * | 6/2000 | Mullin | A61G 7/1019 5/81.1 R |
| 6,085,368 | A | 6/2000 | Robert et al. | |
| 6,637,610 | B1 | 10/2003 | Cheeseboro | |
| 7,240,621 | B2 | 7/2007 | Chepurny et al. | |
| 7,618,223 | B1 | 11/2009 | Begley | |
| 7,634,825 | B2 | 12/2009 | Chepurny et al. | |
| 2003/0092524 | A1 | 5/2003 | Baranda et al. | |
| 2004/0075007 | A1 * | 4/2004 | Goldstein | B62D 43/045 242/370 |
| 2005/0115914 | A1 | 6/2005 | Chepurny et al. | |
| 2006/0002252 | A1 | 1/2006 | Faucher et al. | |
| 2006/0253977 | A1 | 11/2006 | Hjort | |
| 2007/0267084 | A1 | 11/2007 | Pereira et al. | |
| 2010/0064432 | A1 * | 3/2010 | Duquette | A61G 7/1015 5/88.1 |
| 2010/0270252 | A1 | 10/2010 | Chepurny et al. | |
| 2013/0019401 | A1 * | 1/2013 | Faucher | A61G 7/1015 5/85.1 |

FOREIGN PATENT DOCUMENTS

| | | | |
|---|---|---|---|
| GB | 2231500 | A | 11/1990 |
| WO | 2005/094255 | A2 | 10/2005 |
| WO | 2006/085881 | A1 | 8/2006 |
| WO | 2008/029272 | A2 | 3/2008 |

OTHER PUBLICATIONS

International Preliminary Report on Patentability and Written Opinion dated Mar. 15, 2011, of PCT International Application No. PCT/US2009/056660, filed Sep. 11, 2009.
International Search Report and Written Opinion of Application No. PCT/US20009/056660, dated Oct. 22, 2009.
Extended European Search Report in corresponding EP Application No. 16167571, dated Sep. 2, 2016.

* cited by examiner

INFECTION CONTROL STRAP AND PATIENT LIFTING SYSTEM

CROSS REFERENCE TO RELATED APPLICATIONS

This application is a continuation-in-part application of U.S. patent application Ser. No. 12/558,077, filed on Sep. 11, 2009, which claims the benefit of priority to U.S. Provisional Patent Application No. 61/095,970, filed on Sep. 11, 2008. The entire contents of these applications are incorporated by reference below.

BACKGROUND

The present invention relates to a support member and patient lifting device for displacing persons between various positions and locations. More specifically, the present invention relates to an infection control lifting strap and system for lifting and positioning patients using a non-porous, sealed strap to provide improved infection control.

Patient lifting devices allow persons to be displaced between various positions and locations. The devices are typically used to lift and move patients that may not be otherwise moved without injury or substantial effort by either the patient or the caregiver. The patient needing intervention from a lifting device is usually overweight, dystrophied, unconscious, or injured.

A traditional patient lifting device uses manual labor to displace the patient. Manual patient lifting devices may use hydraulic pumps or other fluid- or air-powered pumps to assist the caregiver moving the patient. The pump is attached to a lever that the caregiver may raise and lower to displace the patient into various positions and locations. Depending on the strength and experience of the caregiver, as well as the type of pump used, this type of device may be difficult or even dangerous to use for both the patient and the caregiver. However, it is still readily available due to its lower cost.

More recent patient lifting devices are electrically operated. Electric patient lifting devices utilize a motor system to raise and lower the patient. Once the patient is secured to the device, the caregiver simply uses a button or switch to cause the motor to displace the patient. Electric patient lifting devices have become the preferred devices due to their ease of use and minimal human involvement, limiting the risk of misuse and accident, or injury to the patient and caregiver. Furthermore, electric patient lifting devices do not require an exterior lever, and as such, may be more compact and can more easily be wall- or ceiling-mounted, leaving floor space unoccupied.

Both ceiling- and floor-mounted electrical lifting devices have a motor and winch assembly attached to a fabric lifting strap. The fabric lifting strap is attached to a sling in which the patient sits or lays to be moved from one position into another. In order to load the patient into the sling, and in regular daily use, caregivers, patients, maintenance personnel, and housekeeping staff may touch or grab the fabric lifting strap multiple times. Unfortunately, fabric lifting straps are exceedingly difficult to properly disinfect.

Although some lifting devices are positioned in family homes, most are used in group settings, such as assisted living facilities, nursing homes, doctor's offices, and hospitals. These group locations may use a single lifting device to transport multiple patients throughout the day. The patients may have different diseases or conditions that can be spread through multiple uses of the same device. Such a spread of potentially dangerous pathogens is undesirable, especially in group locations where widespread sickness could occur.

SUMMARY

Therefore, there is a need for a lifting device that minimizes the risk of cross-contamination between patients, as well as between patients and caregivers. The present invention answers that need by providing for a non-porous, completely sealed, plastic lifting strap that can be easily and quickly wiped down with any standard hard surface disinfectant. In addition, the infection control lifting strap of the present invention has a sturdy metal core that is more durable and reliable than a conventional fabric strap.

A support member for use in a patient lifting device is described. The support member includes an improved lift strap having an inner core and an outer plastic layer that can be easily and effectively cleaned with standard disinfectant. The lift strap is secured to a patient lifting device with a spool assembly that guides the lift strap and a belt clamp assembly that compresses the lift strap and holds it in place.

In one embodiment, the support member is used in an electric ceiling- or floor-mounted patient lifting device. The lifting device includes a track component attached to a winch assembly. The winch assembly has an electric motor that raises and lowers the lift strap by means of a spool assembly and belt clamp assembly. The belt clamp assembly attaches to a sling that supports the patient while he or she is displaced.

Still other aspects, features, and advantages of the present invention are readily apparent from the following detailed description, simply by illustrating a number of exemplary embodiments and implementations, including the best mode contemplated for carrying out the present invention. The present invention also is capable of other and different embodiments, and its several details can be modified in various respects, all without departing from the spirit and scope of the present invention. Accordingly, the drawings and descriptions are to be regarded as illustrative in nature, and not as restrictive.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

A support member, including an improved lift strap, for use in a patient lifting device is described. In the following description, for purposes of explanation, numerous specific details are set forth in order to provide a thorough understanding of the exemplary embodiments. It is apparent to one skilled in the art, however, that the present invention can be practiced without these specific details or with an equivalent arrangement.

The present invention provides a support member for use in a patient lifting device. The support member includes a lift strap having an inner core and an outer non-porous plastic layer and means for securing the lift strap to the patient lifting device. The means for securing the lift strap to the patient lifting device include a cylindrical spool operably connected to a first end of the lift strap, where the spool has at least one strap guard positioned at a distal end of the spool. The means for securing the lift strap to the patient lifting device further include one or more cylindrical thickness rollers having an exterior guiding channel configured to support the lift strap and a belt clamp assembly operably connected to a second end of the lift strap.

Likewise, the present invention provides a patient lifting device for displacing persons between various positions or areas. A patient lifting device in accordance with the present invention includes a track component, an electric motor connected to the track component, a lift strap having an inner core and an outer non-porous plastic layer, means for securing the lift strap to the track component, a belt clamp assembly operably connected to a second end of the lift strap, a lifting frame operably connected to the belt clamp assembly, and a sling. The means for securing the lift strap to the track component include a cylindrical spool operably connected to a first end of the lift strap, where the spool has at least one strap guard positioned at a distal end of the spool. The means for securing the lift strap to the track component also includes one or more cylindrical thickness rollers having an exterior guiding channel configured to support the lift strap and a belt clamp assembly operably connected to a second end of the lift strap.

Figure 1:
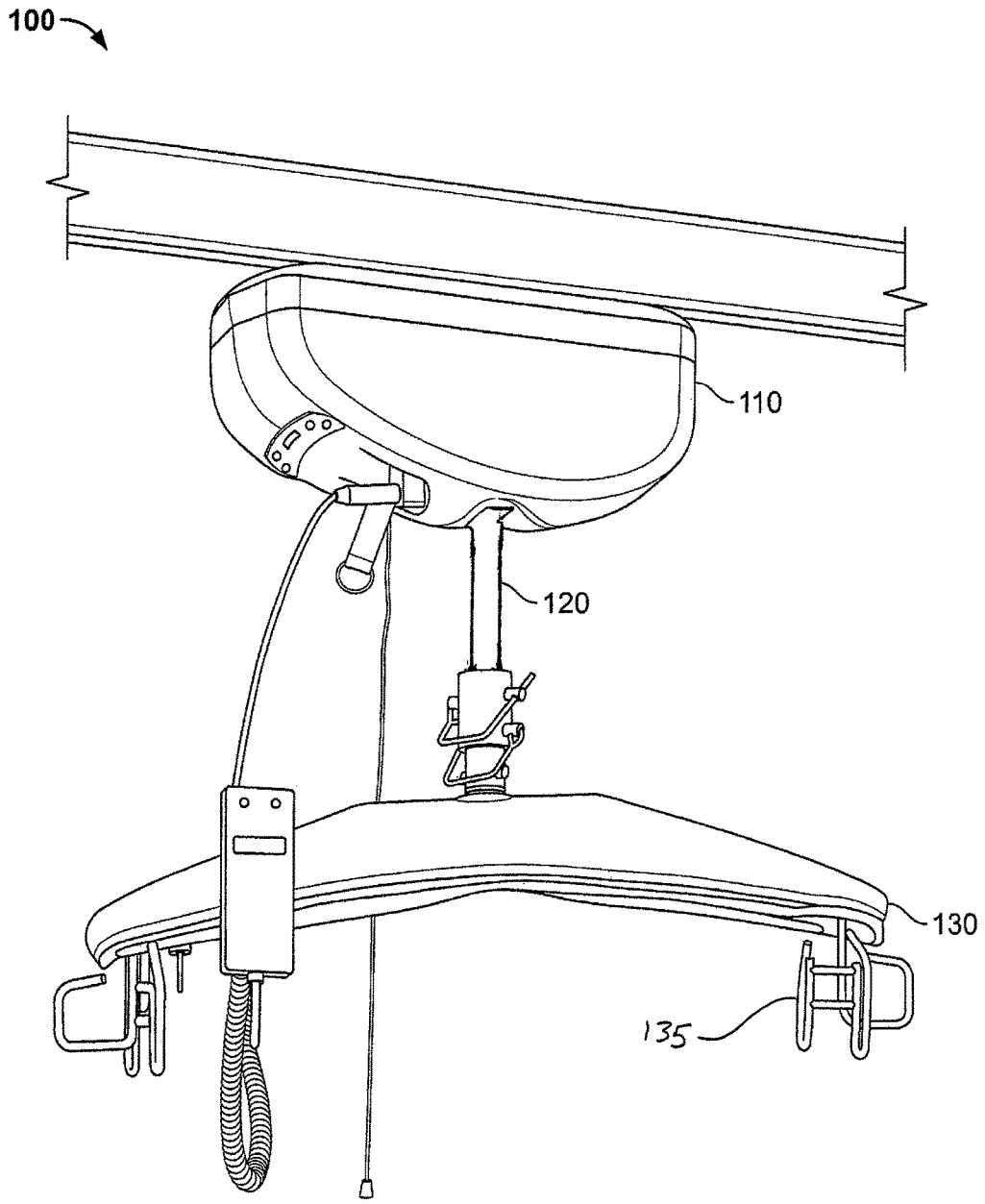
FIG. 1 is a diagram illustrating a patient lifting device with a lift strap assembly in accordance with the present invention.

Referring now to the drawings, wherein like reference numerals designate identical or corresponding parts throughout the several views, FIG. 1 shows a patient lifting device 100 for displacing persons between various positions or areas according to one embodiment of the present invention. Housing component 110 includes a track component connected to an electric motor (not shown). The electric motor drives the movement of the lift strap through a gear and spool assembly, described below. Lift strap 120 extends from housing component 110 to lifting frame 130. A lifting sling may be removably attached to lifting frame 130.

Figure 3:
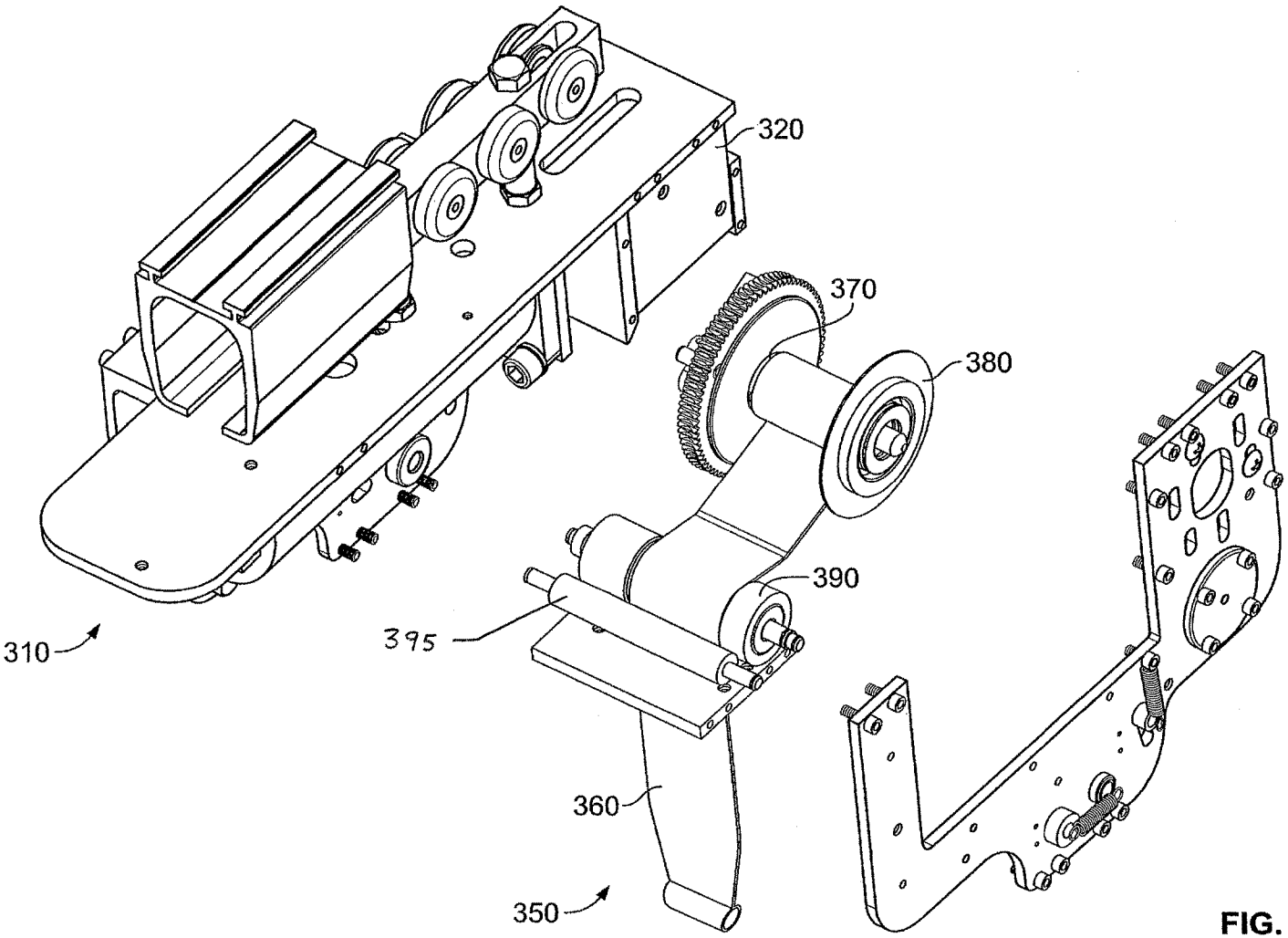
FIG. 3 is a diagram illustrating the components of a lift strap assembly according to one embodiment of the present invention.
Figure 10A:
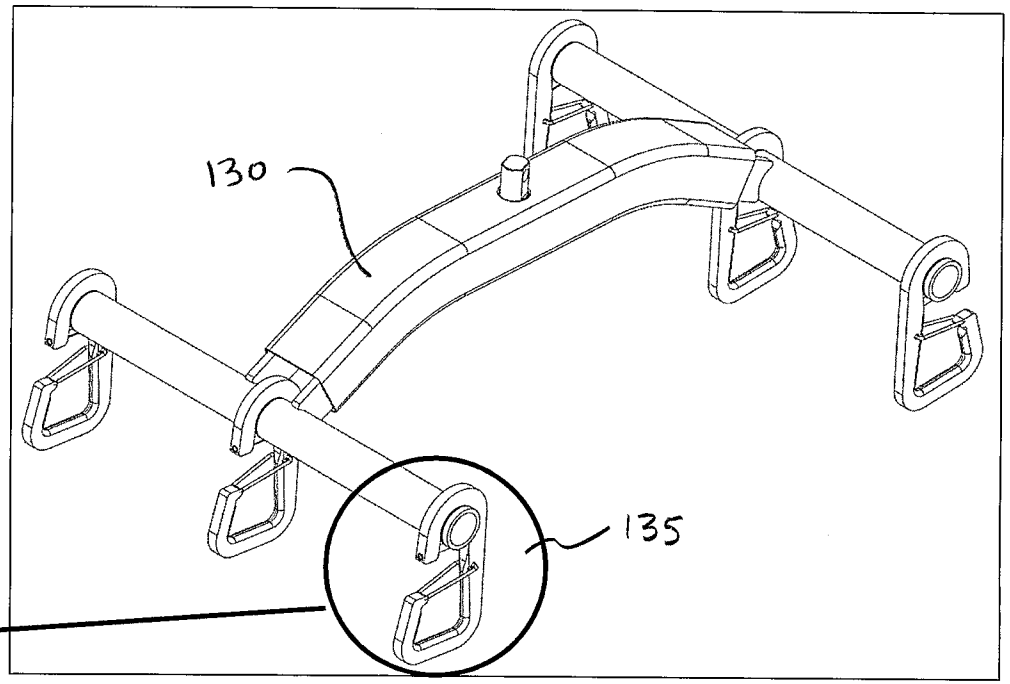
FIGS. 10A and 10B illustrate articulating hooks and a lifting frame (spreader bar) according to one embodiment of the invention.
Figure 10B:
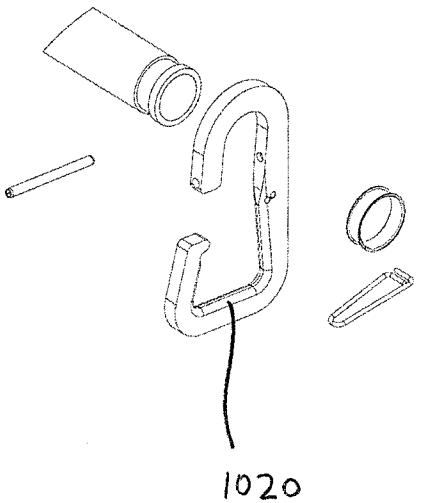

The lifting frame 130 (spreader bar) provides an interface between the ceiling lift housing component 110 (and the components housed inside as shown in FIG. 3, for example) and the patient lifting sling (not shown separately). As shown further in FIGS. 10A and 10B, the hooks 135 on the lifting frame 130 (spreader bar) form attachment points for sling loops that secure the lifting sling. Prior systems typically attach hooks rigidly to the lifting frame (spreader). The hooks 135 in the patient lifting device of the claimed invention pivot and laterally rotate freely. This mounting configuration allows the hooks to swivel and follow the load line of the sling loops to eliminate twisting and stress of rigid hooks and to reduce the risk of damage to both the lifting frame 130 (spreader bar) and the sling. The pivoting hooks 135 provide another advantage in that the portion 1020 of the hook that contacts the sling loop can be flat to ensure full and even contact with the sling loops. This configuration distributes the load across the sling loops and hooks evenly.

Figure 2A:
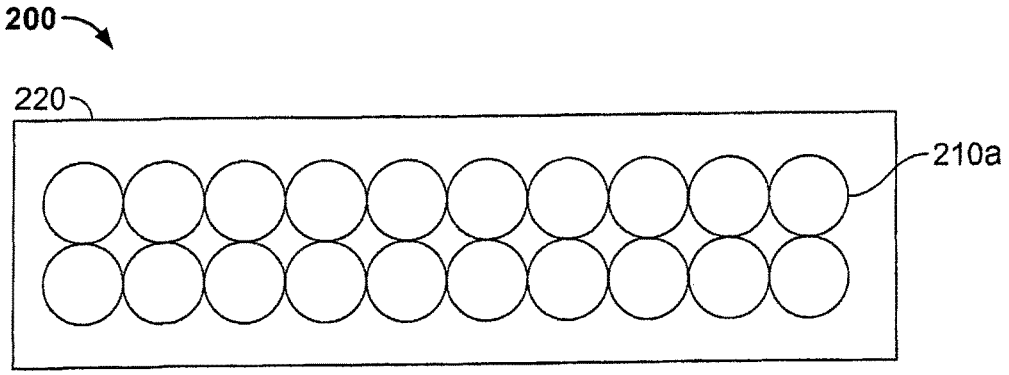
FIGS. 2A-2B are cross-sections of a lift strap according to certain embodiments of the present invention.
Figure 2B:
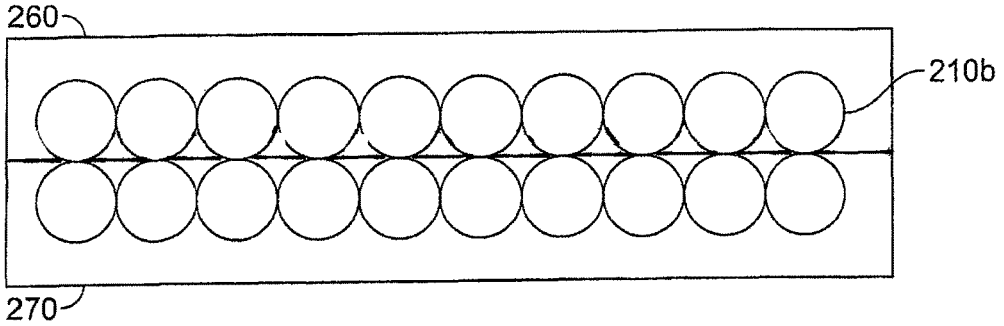

FIGS. 2A and 2B illustrate crass-sections of lift straps in accordance with embodiments of the present invention. FIG. 2A shows crass-section of lift strap 200 having inner core 210*a* and outer non-porous layer 220. Inner core 210*a* is composed of a plurality of thin reinforcing strands that may be a high-strength, high-flexibility material. For example, inner core 210 may be comprised of strands of a high-strength, high-flexibility material with good chemical and corrosion resistance, such as high strength steel, stainless steel, carbon fibers, or Kevlar®. Outer non-porous layer 220 may be plastic, but may also be any other non-porous materials or flexible food grade plastics, such as polyurethane, polystryrene, polytetrafluoroethylene, nylon, or acetal. Outer non-porous layer 220 is suitable for continuous and effective cleaning with diluted cleaning agents, particularly those found in acute and long-term care facilities. In one embodiment, lift strap 200 is ultra-thin, preferably 0.083 inches or thinner, so that the diameter of lift strap 200 on a spool varies little when lift strap 200 is wound. This results in lower overall current draw on the motor and a smaller increment in current draw between fully extended and fully retracted positions.

FIG. 2B shows crass-section of lift strap 250 also having inner core 210. Lift strap 250 has outer non-porous top layer 260 and outer non-porous bottom layer 270, with outer non-porous top layer 260 having a higher coefficient of friction, μ, than outer non-porous bottom layer 270. Outer non-porous top layer 260 and outer non-porous bottom layer 270 may also be a non-porous material, such as plastic or polyurethane, and may be made of the same or different materials. A higher coefficient of friction may be produced on outer non-porous top layer 260 than on outer non-porous bottom layer 270 by a number of methods, including using a more frictional material than is used on outer non-porous bottom layer 270, applying a coating to top layer 260, or by etching top layer 260. Outer non-porous top layer 260 is positioned facing the interior of a spool assembly to gain the benefit of the difference in the coefficients of friction and to prevent lift strap 250 from slipping, squeaking, or tightening on itself.

FIG. 3 illustrates the components of a lift strap assembly according to one embodiment of the present invention. Track component 310 houses electric motor 320 and is configured to house spool assembly 350. Spool assembly 350 is configured to connect lift strap 360 to track component 310. Spool assembly 350 includes spool 370 with strap guard 380 positioned on one end of spool 370.

Spool 370 may have a cylindrical or other rounded edge shape that allows for smooth winding and dewinding of lift strap 360 at a relatively constant speed. Spool 370 has a diameter that maintains a constant shear stress on lift strap 360. Spool 370 is of sufficient diameter that lift strap 360 does not become damaged or destroyed in use by tangling, overlapping, or otherwise winding upon itself. Strap guard 380 may be made of a conductive material, such as aluminum, to prevent the friction of lift strap 360 from generating high temperatures as lift strap 360 passes over guard 380. The aluminum or other conductive material may be used to radiate heat from lift strap 360. By conducting heat from lift strap 360, lift strap 360 will not deform or change in cross-section area, which may affect performance. Lift strap 360 is wound onto spool 370 and is threaded through one or more thickness rollers 390. Lift strap 360 then extends gravitationally downwards to attach, for example, to lifting frame 130.

As shown further in FIGS. 3, 6, and 8A-8D, the components of the spool assembly 350, including spool 370 and thickness rollers 390, 395 housed in a roller housing 808, incorporate large nominal radii R to reduce the amount of flex subjected to the lift strap 360. For example, in one embodiment of the invention the effective radius is 0.1875 inches. In another embodiment of the invention, the effective radius of the spool 370 is 0.157 inches. Likewise, the reduced flex on the lift strap 360 translates to reduced flex on the inner core 210 and the constituent multi-strand inner cables that make up inner core 210. Using large radius components (for example, greater than 0.125 inches) extends the life of the lift strap to over 10,000 patient lifts.

Figure 9:
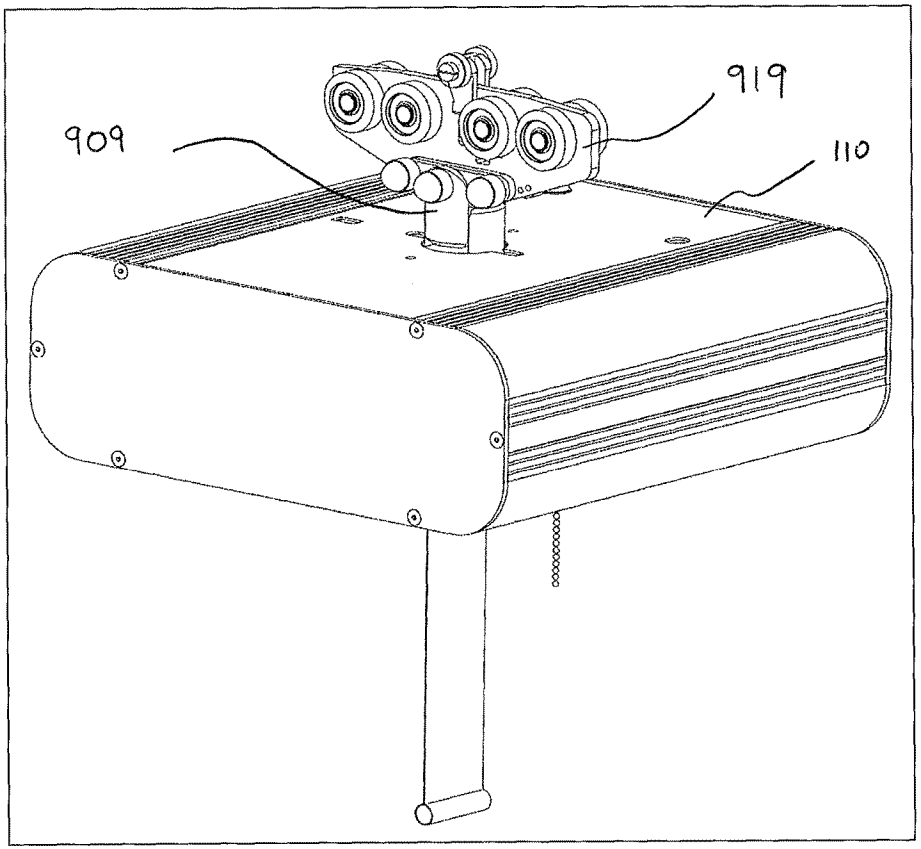
FIG. 9 shows an exemplary load cell used to determine the safe working limit of a patient lift device in accordance with the invention.

In conjunction with the large radii components, the support member in the patient lifting device of the claimed invention includes a load cell 909 as shown in FIG. 9, which can be positioned between trolley 919 and housing component 110. The load cell 909 creates an electrical signal proportional to a measured force. Regulating entities often require lifting systems to pass a proof test with a load of 150% of the rated load capacity, or safe working load (SWL). For example, a patient lifting device rated for 600 lbs. must be able to lift 900 lbs. The load cell 909 measures the weight lifted (e.g., patient mass acted upon by gravity) by the patient lifting device and outputs a proportional electrical signal (such as an electrical current) to a controller. The controller can be one or more electrical circuits that command and direct lift and lower functions of the patient lifting device of the claimed invention. The heavier the weight lifted by the device, the larger the current received at the controller. A maximum load cut-off can be set based upon the current level received at the controller when the patient lifting device lifts the load proof test weight. When the electrical current reaches the cut-off value corresponding to the proof test weight, the system disables the lift.

However, the current required to lift the maximum load is dependent upon the (vertical) position of the load over the lifting range of the patient lifting device. At the top of its vertical travel, the ceiling lift may require more than twice the current to lift the same weight as it would when the lift strap is in a fully extended position (patient lift's lowest position). With the lift strap in a fully extended position (lowest position), the effective radius of the spool is a minimum value. As the system lifts a patient, the system retracts the lift strap, and it coils around the spool 370, and the effective radius of the spool 370 increases. This larger radius spool requires a larger force to turn it. The system applies electrical current to turn the spool, and more current is required to apply more force. When lifting a patient from a fully extended position (lowest) to a fully retracted position (highest), the radius of the spool can double. To meet the 150% proof test, the patient lift device of the claimed invention includes a load cell to overcome the current limitations and supply the effective current needed to lift the designated weight (patient) at any point over the lifting range.

Figure 11:
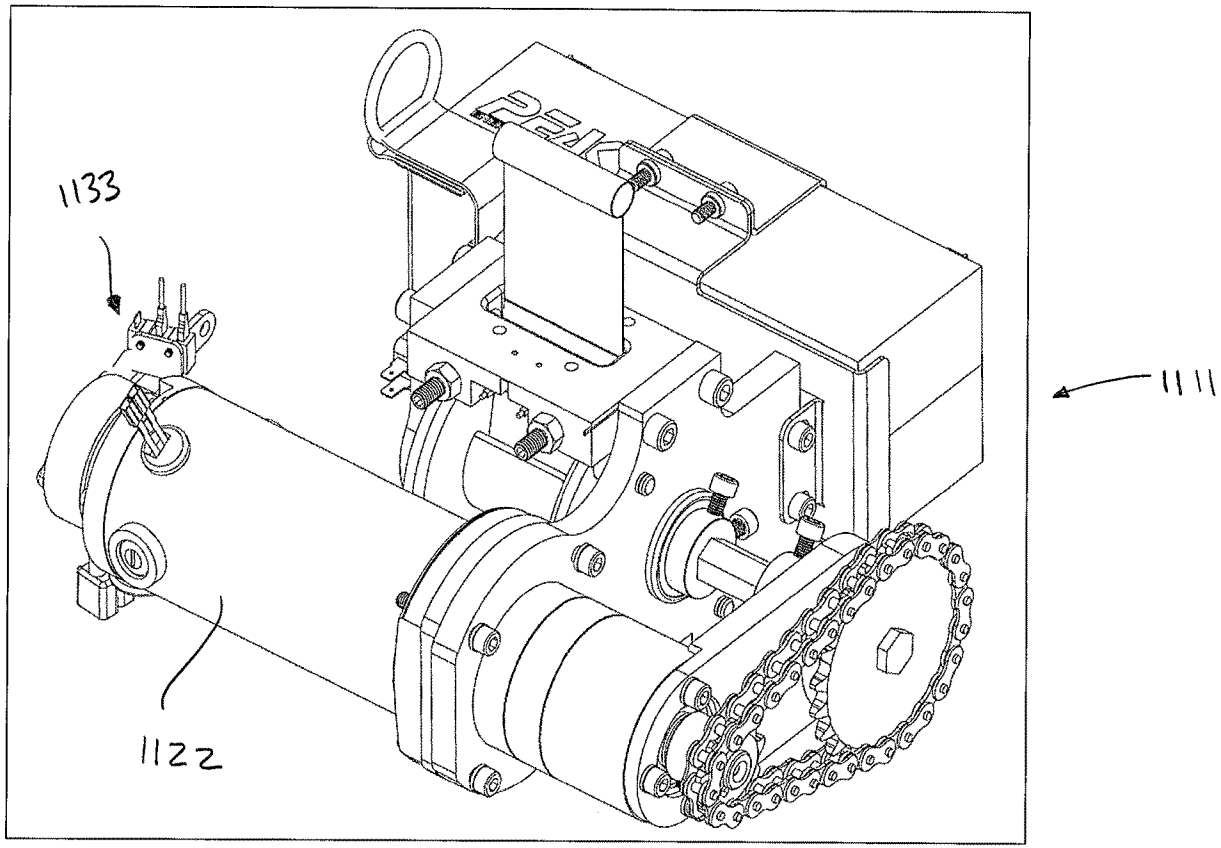
FIG. 11 illustrates a high efficiency gearbox in accordance with one embodiment of the invention.
Figure 12:
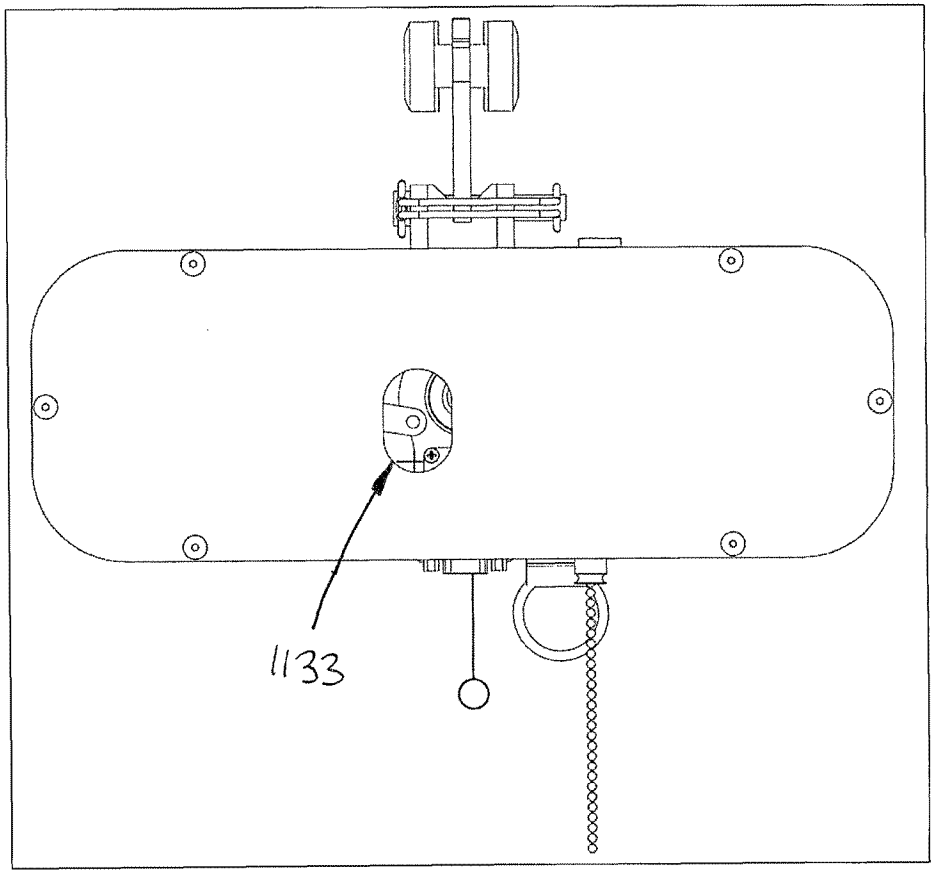
FIG. 12 shows an electromechanical brake used in conjunction with the high efficiency gearbox of FIG. 11.

Prior systems inefficiently transmit power from an electric motor to a lift belt spool. Often, the efficiency lost in transferring power to the lift belt spool serves to prevent the patient's weight from back-driving the motor and keeps the patient is a stationary position when the lift is idle (i.e., the lift is not being raised or lowered). The patient lifting device of the claimed invention utilizes a high efficiency gearbox 1111 (shown in FIG. 11) capable of transferring power from the electric motor 1122 to the lift belt spool 370 with approximately double the efficiency of prior systems. The gearbox 1111 provides optimum resistance of the load to transfer the most power from the source (motor 1122) to the load (spool 370). Power dissipated in the load is proportional to the voltage across the load and the applied current. To maximize the power transfer, the load resistance is matched to the source resistance. The system employs a high efficiency gearbox 1111 to dynamically match the load to the source. The high efficiency gearbox 1111 provides maximum power transfer that improves battery life and lifting capability. The high efficiency gearbox 1111 of the claimed invention allows a patient's weight to back drive the motor when the motor is not engaged. An electro-mechanical brake 1133 (shown in FIGS. 11 and 12) on the motor armature locks the motor 1122 when the ceiling lift is idled to prevent back driving and to provide a fail safe condition. The patient lifting device can be pre-loaded using the controller to smoothly release the electro-mechanical brake 1133 when power is re-applied.

The high efficiency gearbox 1111 provides additional benefits. Regulatory agencies require ceiling lifts to include an emergency lowering function ("e-down") when power is cut off from the system (such as in a power failure, for example). Prior ceiling lifts do not allow back-drive through the transmission. That is, the transmission of prior systems engages even when no power is applied. To lower a patient in an emergency lowering scenario, prior systems utilize a battery backup to provide power to the motor to lower the patient. With the high efficiency gearbox 1111 of the claimed invention, in the event of a power failure, the system can simply release the electro-mechanical brake 1133 and passively lower the patient with the lowering function force provided exclusively by gravity. The claimed invention uses no additional drive and no additional power source to lower a patient when power is removed from the system, such as in an emergency.

Figure 4:
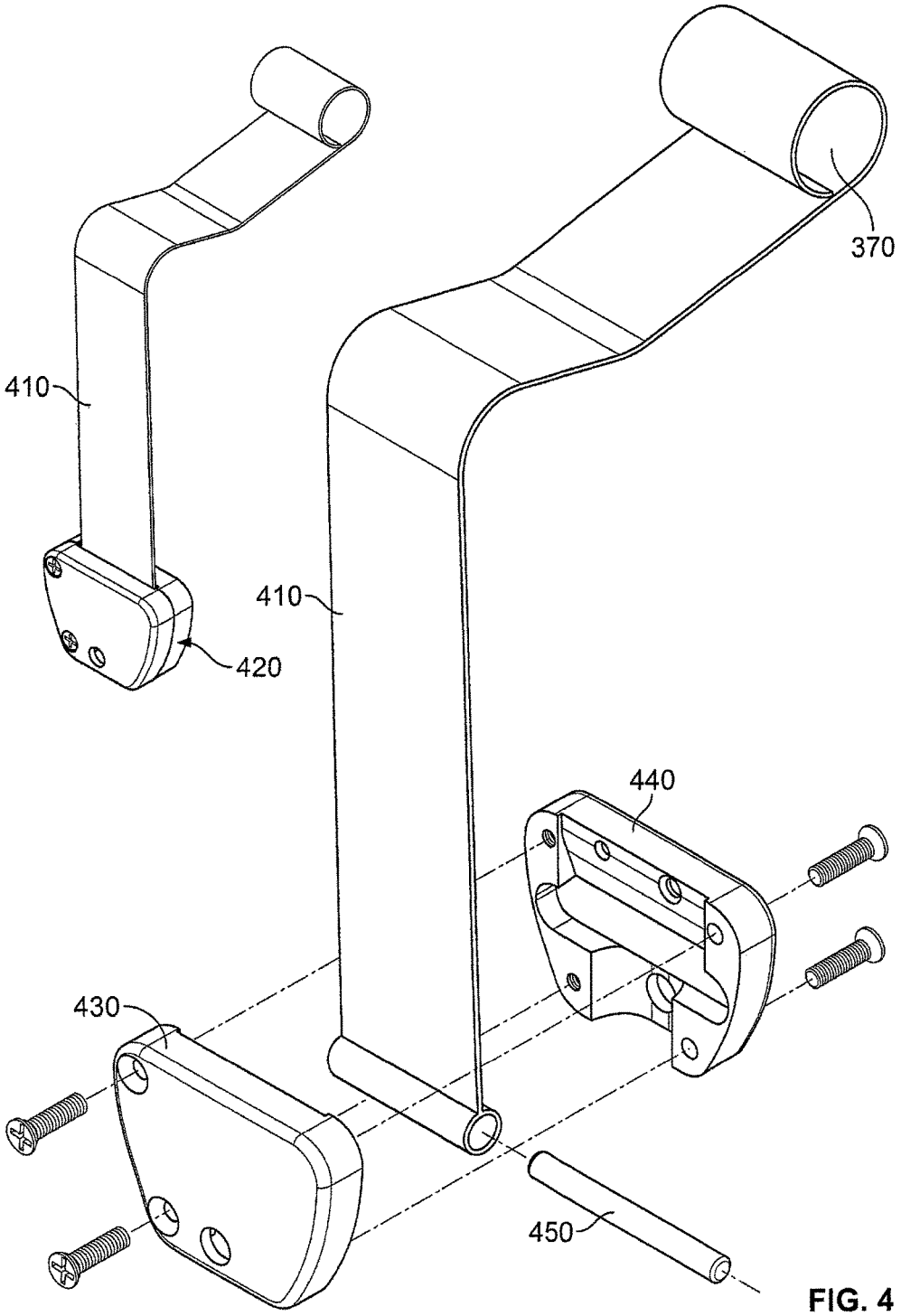
FIG. 4 is a diagram illustrating a belt clamp assembly and lift strap according to another embodiment of the present invention.
Figure 5A:
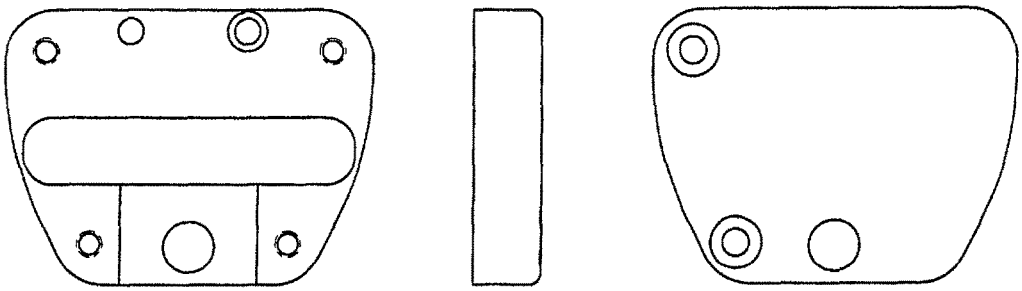
FIGS. 5A-5B are diagrams of belt clamps according to other embodiments of the present invention.
Figure 5B:
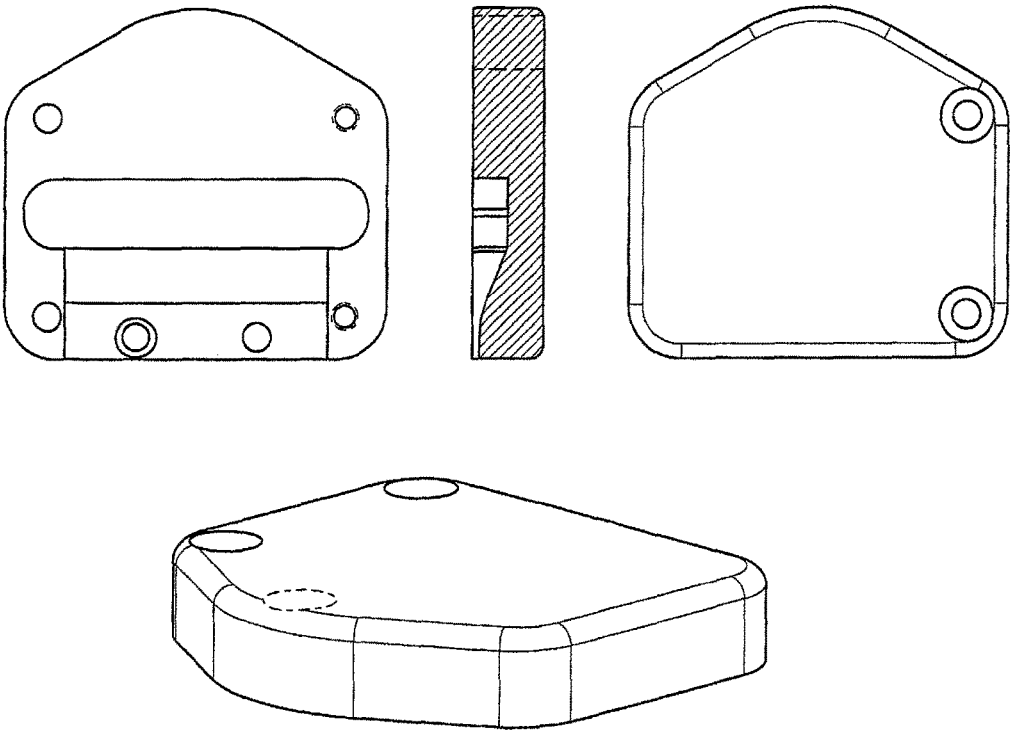

FIG. 4 illustrates belt clamp assembly 420 with lift strap 410. As shown in the larger exploded view in FIG. 4, lift strap 410 extends from spool 370 down to belt clamp sides 430 and 440. Lift strap 410 houses clamp pin 450 on its lower end and is compressed by clamp sides 430 and 440. Clamp sides 430 and 440 may be held together by fastening devices or materials, including basic screws, as shown. Clamp sides 430 and 440 secured in a fashion that does not damage or otherwise cause perforations on lift strap 410. Thus, advantageously, the maximum load weight of lift strap 410, typically between 1,000 and 3,200 pounds, is not weakened due to perforations, cuts, or holds caused by clamp sides 430 and 440. Furthermore, lift strap 410 is completely sealed and does not have recesses or crevices in which fluids or other materials may infiltrate, thereby minimizing bacterial, viral, and other germ growth. The sealed belt clamp assembly forms an impregnable, waterproof seal that prevents liquids and other fluids from reaching the clamp pin 450. The sealed assembly thereby decreases the risk of infection to the patient, caregiver, or other operator or handler of the patient lifting device. A number of geometric variations are possible for clamp sides 430 and 440. For example, the clamp sides may have the shape of a rounded-edge trapezoid, as shown in FIG. 5A, or a rounded-edge pentagon, as shown in FIG. 5B, for example.

Figure 13:
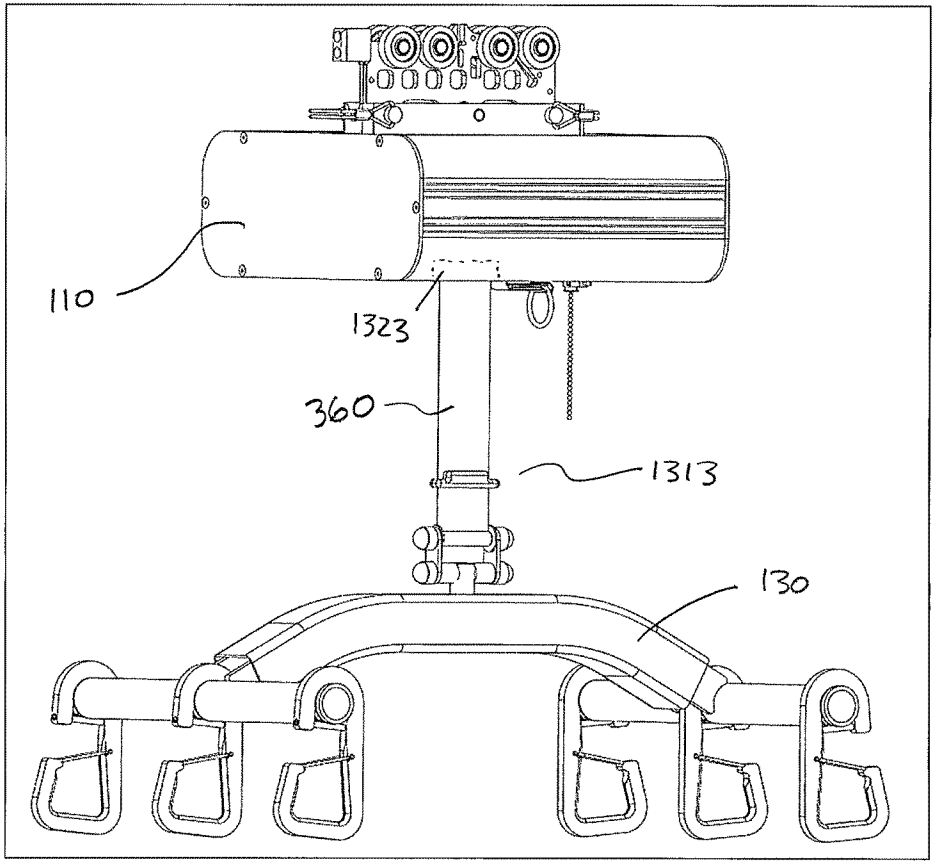
FIG. 13 shows a clamp-on limit switch and a lift strap in one embodiment of the invention.

In addition to clamping the lifting frame 130 (spreader bar) to the lifting strap 410 to reduce perforations in the strap 410 and the possibility of infection through bacterial infiltration, the claimed invention incorporates a similar clamping mechanism in upper limit switch 1313 shown in FIG. 13. Ceiling-mounted patient lifts often have an upper limit switch to prevent damage that could be caused by retracting the lifting frame 130 (spreader bar) into the lift 110. Previous systems often stop lift operation when the spreader bar is a few inches from the lift. The upper limit switch 1313 incorporates a cylindrical rare-earth magnet clamped onto the lift strap 360 to avoid perforating the lift strap 360 and to reduce the chance of infection. A reed switch 1323 in the lift 110 senses the magnetic field from the magnet in the clamped upper limit switch 1313 and disables the lift 110 when the sensed magnetic field is above a threshold limit. That is, the magnet in the clamped upper limit switch 1313 moves toward (vertically upward) reed switch 1323 as the lift strap 360 retracts as the patient is raised. When the magnet in the clamped upper limit switch 1313 moves closer to the reed switch 1323, the sensed magnetic field increases until the threshold is reached, and further vertical motion ceases. The position of the clamped upper limit switch 1313 on the lift strap 360 can be changed depending upon the environment in which the patient lift device is used.

Figure 6:
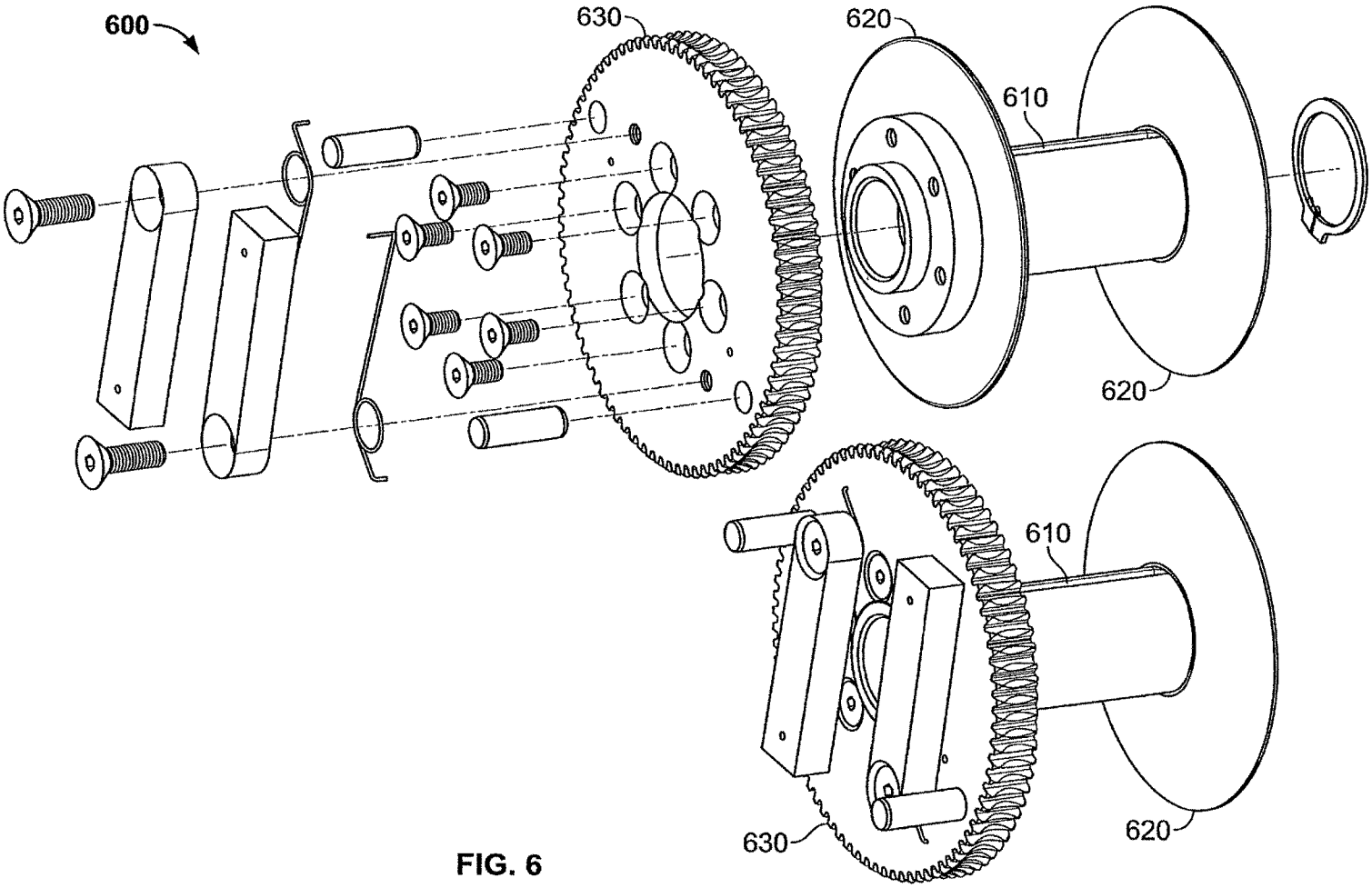
FIG. 6 is a diagram illustrating a belt spool assembly according to one embodiment of the present invention.

FIG. 6 is a detailed diagram illustrating belt spool assembly 600 according to one embodiment of the present invention. Spool assembly 600 includes spool 610, strap guards 620, and at least one gear wheel 630. As discussed above, it is preferred that spool 610 has a diameter that is not too small, and preferably 1.1 inches or greater, such that no significant shear stress is put on the lift strap so as not to damage or destroy it in use. Strap guards 620 function to protect the lift strap from wear caused by gear wheel 620, and to prevent any grease used on gear wheel 620 from getting on the lift strap. Strap guards 620 may be made of a conductive material, such as aluminum, so as to draw heat away from the lift strap and prevent heat damage to the strap. In operation, gear wheel 630 engages with a warm gear (not shown) on the motor of the patient lifting device to drive spool 610, which in turn winds and unwinds the lift strap from spool 610.

The manner in which the lift strap attaches to the spool can affect performance and durability of the lift strap and the patient lift device in general as well as the comfort of the patient. In previous systems, a lift strap could be attached to the spool on the surface of the spool. In previous systems, the attachment point is necessarily raised above the surface of the spool. As the spool rotates and the lift strap coils onto the spool and then onto itself, the strap spools unevenly due to the raised attachment point. The motor controller experiences a spike in the torque feedback received, which in turn produces a spike in the applied current to the patient lift. The patient experiences a small oscillation/jerk corresponding to the spike in applied current.

Figure 8D:
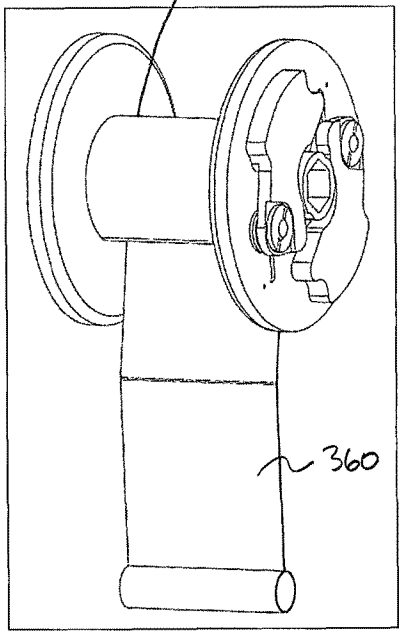
FIGS. 8A-8D illustrate large radius components used in the lift strap path of travel in accordance with the claimed invention.
Figure 8B:
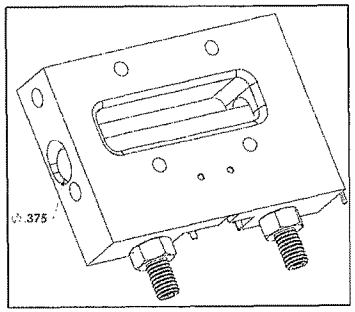
Figure 8C:
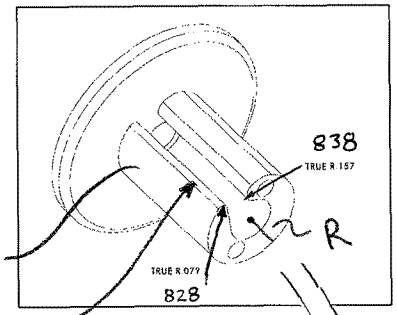
Figure 8A:
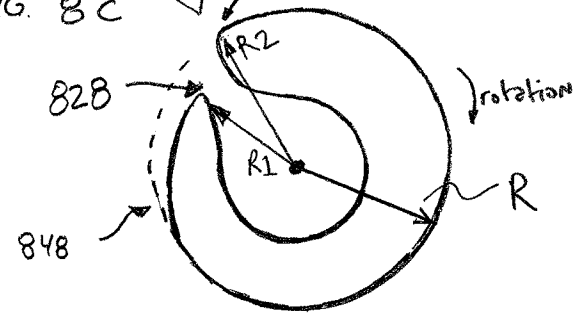
Figure 8A:
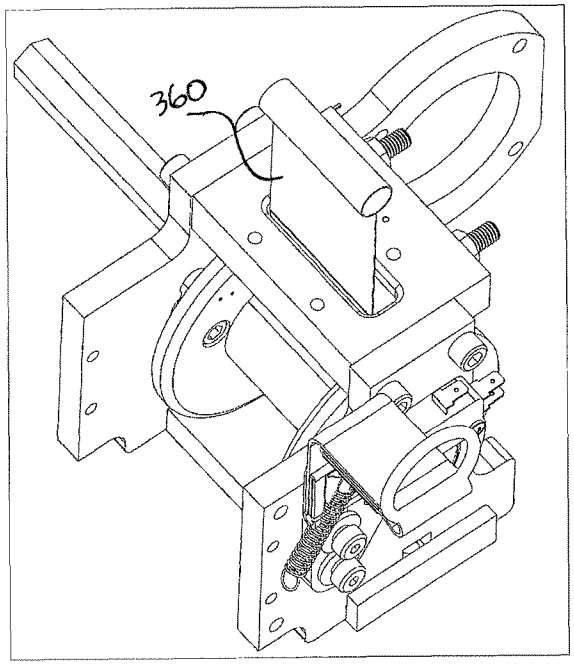

As shown in FIG. 8C, in the patient lifting device of the claimed invention, the lift strap attachment slot 818 produces no increase in belt spool diameter where the lift strap 360 attaches to the spool 370. As shown in the cross sectional enlargement of FIG. 8C, the spool 370 is eccentric in that the base cylinder 848 (base circle) includes a base radius R (nominal radius) along with a reduced radius R1 at the exit point 828 of the attachment slot 818. Lift strap 360 can include a pin (similar to clamp pin 450 in FIG. 4) concentrically inserted in the spool 370 such that the lift strap 360 exits the spool from the lift strap attachment slot 818 at exit point 828. That is, the lift strap 360 exits from the center of the spool 370 at R1, which is at a radius distance slightly less than the nominal spool radius R (also distance R2 on the other side 838 of the lift strap attachment slot 818. The difference between R2 and R1 can be the thickness of the lift strap 360.

As shown in the cross sectional detail of FIG. 8C, this difference in the radii of the eccentric spool 370 includes one side 828 of the lift strap attachment slot 818 that is at a shorter distance (radius R1) than the other side 838 of the lift strap attachment slot 818. In one example of the invention, the shorter distance (radius R1) on one side 828 can be 0.079 inches, and the larger distance (radius R2) on the other side 838 of the lift strap attachment slot 818 can be 0.157 inches. Other example embodiments can be configured where the difference in distance between R1 and R2 is substantially the same as the thickness of the particular lift strap used.

As the eccentric spool 370 rotates, the lift strap 360 initially drapes and coils onto the spool 370 at exit point 828, and the addition of the thickness of the lift strap 360 to the slightly lower spool surface (of the arc beginning at the exit point 828) makes the entire effective radius equal to the nominal spool radius R. The spool configuration, including the attachment point 818 and the eccentric radius of the spool provides a uniform surface upon which the lift strap 360 drapes and coils onto the spool and eliminates the applied current spikes, the oscillation/jerk of the lift strap during travel, and patient discomfort or negative effects resulting from the uneven travel.

Figure 7:
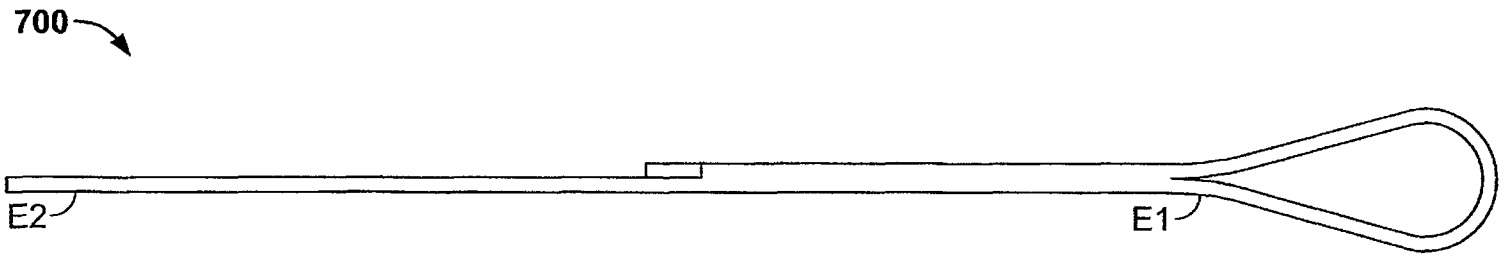
FIG. 7 is a diagram illustrating a welded lift strap according to one embodiment of the present invention.

FIG. 7 is a side view of lift strap 700. At a first end E1, lift strap 700 is folded over itself and either welded to itself or bonded by adhesives to create a fastener-free loop with which to connect belt clamp assembly 420. Thus, when attached to belt clamp assembly 420, lift strap 700 is not damaged, perforated, stitched, or riveted through with mechanical fastenings, as discussed above. Advantageously, lift strap 700 is attached to lifting frame 130 in a manner that minimizes areas for moisture and germs to accumulate without weakening the strength of the belt.

As outlined above with regard to FIGS. 2 and 3, lift strap 200 includes a multi-strand inner (core) cable 210 for high flexibility. The multi-strand inner cable 210 allows the sealed strap 200 to be used in a small envelope in the thickness rollers in the spool assembly 350. Some patient lift configurations rout a cable inside the lift in a serpentine manner, with many contact points and rolling points on all internal components. The lifting strap 360 of the claimed invention uses a multi-strand inner cable 210 for increased flexibility over the lifting path components, including the thickness rollers 390, 395. Fewer contact points in the spool assembly 350 provides fewer contamination points and easier and more effective cleaning that reduce the risk of infection.

The present invention has been described in relation to particular examples, which are intended in all respects to be illustrative rather than restrictive. Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

We claim:

1. A patient lifting device comprising:

an infection control lift strap having an inner core and a sealed outer non-porous plastic layer, the inner core including a plurality of flexible reinforcing strands arranged in a rectangular cross-section; and a spool assembly coupled to the lift strap, the spool assembly comprising:

an eccentric cylindrical spool including a lift strap attachment slot configured with an exit point, where the exit point is at a radial distance less than a nominal radius of the eccentric cylindrical spool.

2. A patient lifting device as recited in claim 1, wherein the radial distance of the exit point is less than the nominal radius of the eccentric cylindrical spool by substantially the same distance as the thickness of the lift strap.

3. A patient lifting device as recited in claim 1, wherein the spool assembly further comprises:

a cylindrical thickness roller upon which the lift strap is threaded, the cylindrical thickness roller having an exterior guiding channel configured to guide and support the lift strap.

4. A patient lifting device as recited in claim 1, wherein the spool assembly further comprises:

a strap guard positioned at a distal end of the eccentric cylindrical spool and covering the lift strap.

5. A patient lifting device as recited in claim 4, wherein the strap guard is positioned to separate and protect the lift strap from a gear wheel and to prevent debris from contacting the lift strap.

6. A patient lifting device as recited in claim 4, wherein the strap guard includes a conductive material positioned to radiate heat from the lift strap and spool assembly to a track component housing when the lift strap and spool assembly come in contact with each other.

7. A patient lifting device as recited in claim 4, wherein the strap guard includes an interior lateral width that is substantially the same as the width of the lift strap.

8. A patient lifting device as recited in claim 1 further comprising:

a sealed belt clamp assembly coupled to the lift strap, the sealed belt clamp assembly including clamp sides compressing the lift strap about a clamp pin to form a waterproof assembly.

9. A patient lifting device of claim 1, wherein the sealed outer non-porous plastic layer includes:

a non-porous top layer configured to face toward the spool assembly and having a first coefficient of friction; and a non-porous bottom layer with a second coefficient of friction that is less than the first coefficient of friction, wherein the different coefficients of friction of the top layer and the bottom layer prevent slipping of the lift strap on the eccentric cylindrical spool and self-tightening of the lift strap on the eccentric cylindrical spool.

10. A patient lifting device of claim 1 further comprising:

a lifting frame coupled to the lift strap.

11. A patient lifting device of claim 10, wherein the lifting frame includes pivoting sling hooks.

12. A patient lifting device of claim 1 further comprising:

a load cell operably connected to the spool assembly and configured to measure a weight lifted by the lift strap and to output a proportional electrical signal to a controller.

13. A patient lifting device of claim 12, wherein the load cell is further configured to provide a proportional electrical signal to the controller from a fully lowered position of the lift strap to a fully raised position of the lift strap.

14. A patient lifting device of claim 1, wherein the lift strap includes a sealed magnetic limit switch.

15. A patient lifting device of claim 1, wherein the lift strap includes a sealed fastener-free welded loop.

16. A patient lifting device of claim 1 further comprising:

a winch assembly, the winch assembly including a motor that drives a high-efficiency gear assembly.

17. A patient lifting device of claim 16, wherein the high-efficiency gear assembly is configured to dynamically match resistance provided by the lift strap to effect maximum power transfer from the motor to the lift strap.

18. A patient lifting device of claim 16 further comprising:

an electro-mechanical brake that locks the motor and prevents back driving when the patient lifting device is idle.

19. A patient lifting device of claim 18, wherein the high-efficiency gear assembly provides back driving when power is removed from the patient lifting device and the electro-mechanical brake is released.

* * * * *